United States Patent [19]

Rudd et al.

[11] 4,088,402

[45] May 9, 1978

[54] PHOTOCOPYING APPARATUS WITH MAGNETIC BRUSH DEVELOPER AND SHEET GUIDE

[75] Inventors: Robert W. Rudd, Westport; Richard S. Holodnak, Stratford, both of Conn.

[73] Assignee: Pitney-Bowes, Inc., Stamford, Conn.

[21] Appl. No.: 657,409

[22] Filed: Feb. 12, 1976

[51] Int. Cl.[2] ..... G03G 15/09

[52] U.S. Cl. ..... 355/3 DD; 118/657

[58] Field of Search ..... 355/3 SH, 3 DD, 16; 118/656, 657

[56] References Cited

U.S. PATENT DOCUMENTS

| | | | |
|---|---|---|---|
| 3,058,405 | 10/1962 | Limberger | 118/657 |
| 3,632,201 | 1/1972 | Granzow et al. | 355/3 SH |
| 3,698,804 | 10/1972 | Cranskens et al. | 355/3 SH |
| 3,738,743 | 6/1973 | Hoffman et al. | 355/3 SH |
| 3,941,469 | 3/1976 | Okamoto | 355/3 DD |

*Primary Examiner*—A. D. Pellinen
*Attorney, Agent, or Firm*—Thomas R. FitzGerald; William D. Soltow, Jr.; Albert W. Scribner

[57] ABSTRACT

Photocopying apparatus includes a magnetic brush for applying toner to a copy sheet having a photoconductive coating. The apparatus also includes an illuminating station for receiving a document having an image thereon, a lens system for projecting the illuminated document image, a corona charger unit for placing a uniform electrostatic charge on the photoconductive coating of the copy sheet and an imaging station for simultaneously receiving the projected document image and the uniformly electrostatically charged copy sheet. The imaging station includes a conductive around plate effective to allow discharge of selected areas on the copy sheet when struck by the projected image to form a latent electrostatic image in accordance with the document image. The magnetic brush places a uniform layer of magnetically and electrically responsive particulate toner material in contact with a surface moved past a magnetic brush peripheral surface. A copy sheet feed mechanism, that defines a generally C-shaped path to permit the compact design of this photocopying apparatus, feeds the copy sheet from a supply with the conductive coating facing downwardly, sequentially to the corona charger unit, the imaging station, and then under the magnetic brush with the copy sheet photoconductive coating facing upwardly so that toner carried on the bottom peripheral surface of the magnetic brush assembly is deposited on the upwardly facing charged areas of the copy sheet.

3 Claims, 4 Drawing Figures

PHOTOCOPYING APPARATUS WITH MAGNETIC BRUSH DEVELOPER AND SHEET GUIDE

BACKGROUND OF THE INVENTION

1. Field of the Invention

The present invention relates to a compact photocopying apparatus for photocopying a document having written, printed, typed, pictorial, or other images on its face, onto a copy sheet provided with a photoconductive coating such as zinc oxide.

Such photocopying machines are commonly used to make photocopies of original and copied documents such as letters, book pages, drawings, memoranda, telegrams, notes, and any other document having graphic matter on its face. These documents may be handwritten, printed, typed or produced by other graphic or photographic means. Accordingly, as used herein, the term "document" means any handwritten, printed, typed or other graphic or photographic matter.

Photocopying apparatus, of the type to which the present invention relates, should be compact for convenient installation on a table or desk top.

The photocopying apparatus of the present invention is also of the type which utilizes "single component" toner, i.e. a single developing component and, in particular, a magnetically responsive particulate toner material that is attracted to a magnetized body.

Such toner is applied by an assembly generally known as a "magnetic brush" which carries and distributes the magnetically responsive toner onto the copy paper.

DESCRIPTION OF THE PRIOR ART

Photocopying machines which employ various copying processes are presently known. In one type of photocopying machine, a document to be copied is fed along a first feed path past an illuminating station while, simultaneously, a copy sheet is moved along a second feed path past an imaging station. As the document passes the illuminating station, the document image is projected to the imaging station where it is transformed into a latent electrostatic image on the copy sheet. The original document is then returned to the machine operator. The copy sheet carrying the latent electrostatic image is fed to a developing station to be developed and later fixed or fused to ultimately be delivered to the operator.

Photocopying machines which operate basically as described above are disclosed in U.S. Pat. Nos. 2,791,949 (Simmons et al.) and 3,088,386 (Sugarman). A reciprocating document carriage for such a photocopying machine is disclosed in U.S. Pat. No. 3,697,165 (Morriston et al.).

Various processes for developing the latent electrostatic image on the copy sheet are also known. One such process employs a magnetic brush which carries a magnetically responsive toner for contact with the charged copy sheet. Magnetic brush developing apparatus and processes using them are disclosed or illustrated in U.S. Pat. Nos. 3,707,390 (Sullivan); 3,648,656 (Ogawa); 3,584,601 (Turner); 3,553,464 (Abe); 3,552,355 (Flint); 3,523,518 (Sage et al.); 3,457,900 (Drexler); 3,455,276 (Anderson); 3,399,652 (Gawron); 3,219,014 (Mott et al.); 3,058,444 (Sugarmen et al.); 3,040,704 (Bliss); 3,015,305 (Hall et al.); and in British Patent Specification 1,071,697 (Kalle).

U.S. Pat. No. 3,639,245 (Nelson) is directed to developer toner for use in magnetic brush photocopy developing processes.

Other apparatus and processes for photocopy developing are disclosed in U.S. Pat. Nos. 3,196,831 (Sugarman); 3,117,891 (Lehmann); 3,064,622 (Thompson); and 3,037,478 (Lace).

Because of the physical arrangement of their various components, photocopying apparatus such as those disclosed in the Patents noted above are often large and cumbersome, and, therefore, unsuited for desk or table top installation. In addition, this physical arrangement sometimes requires that additional components be included in the photocopier design. For example, photocopying apparatus which feeds a charged copy sheet past the top or side of a developer such as a magnetic brush usually include some means, for example, a vacuum platen or paper tensioning device to hold the copy sheet spaced from the surface of the magnetic brush. This spacing is required to insure proper copy sheet contact with the toner carried on the brush surface.

An example of prior photocopying apparatus which is housed in a large cabinet to feed a copy sheet over the top of a magnetic brush is illustrated in U.S. Pat. No. 3,040,704 (Bliss). This apparatus is not well suited for desk top installation.

SUMMARY OF THE INVENTION

In a preferred embodiment, to be described below in detail, the photocopying apparatus of the present invention is compact for installation on a desk or table top, and may be used to photocopy document images onto a copy sheet having a photoconductive coating.

The photocopying apparatus of the present invention includes an illuminating station for receiving the document face down and a light source for illuminating the document from underneath when in the illuminating station. A lens system projects the image from the document face.

A copy sheet carrying a photoconductive coating which may be, for example, zinc oxide, is fed from a supply to a corona charger unit which places a uniform electrostatic charge on the photoconductive coating. An imaging station receives the charged copy sheet from the corona charger unit and, simultaneously, receives the document image projected through the lens system. The imaging station includes a conductive ground plate which is effective to allow discharge of selected areas on the copy sheet when struck by the projected document image to form a latent electrostatic image in accordance with the document image.

A magnetic brush assembly is provided to place a uniform layer of magnetically and electrically responsive toner material in contact with an imaged copy sheet moved past the peripheral magnetic brush surface.

A copy sheet feed mechanism is provided to feed the copy sheet from the supply sequentially to the corona charger unit, the imaging station, and the magnetic brush assembly. This sheet feed assembly defines a nonlinear path, along which the copy sheet travels, that is generally C-shaped in side elevation. A first leg of the C-shaped feed path is generally horizontal and conducts the copy sheet, with its photoconductive coating facing downwardly. A second leg is generally vertical and feeds the copy sheet through the corona charger unit to the imaging station. A third leg is generally horizontal and feeds the copy sheet from the imaging station, under the magnetic brush with the photoconductive coating facing generally upwardly.

Since the copy sheet feed mechanism defines a generally C-shaped path, the photocopying apparatus of the present invention may be housed in a compact cabinet. There is no need to construct an elongate housing to hold linearally, sequentially arranged photocopying apparatus components.

The copy sheet feed mechanism also includes a pair of feed rolls driven in opposite directions, mounted on the immediate upstream side of the magnetic brush. A novel paper guide is mounted under the magnetic brush to receive copy sheets fed from the feed rolls and has a particular curved cross-sectional shape for putting the copy sheet in contact with the particulate material carried on the magnetic brush. This paper guide is also formed so that copy sheets fed into it closely conform to its surface. Accordingly, there is no need to provide an auxiliary apparatus such as a vacuum platen or paper tensioning device to hold the copy sheet in spaced relation to the surface of the magnetic brush.

Further, the novel arrangement for feeding charged photocopy sheets under the magnetic brush facilitates transfer of the magnetically responsive particulate material to the charged areas of the copy sheets.

Accordingly, it is an object of the present invention to provide an improved photocopying apparatus which is compact in size and efficient in operation for photocopying graphic matter on documents onto a copy sheet having a photoconductive coating.

Other objects, aspects, and advantages of the invention will be pointed out in, or will be understood from, the detailed description provided below, considered with the following drawings.

DETAILED DESCRIPTION OF THE PREFERRED EMBODIMENT

Figure 1:
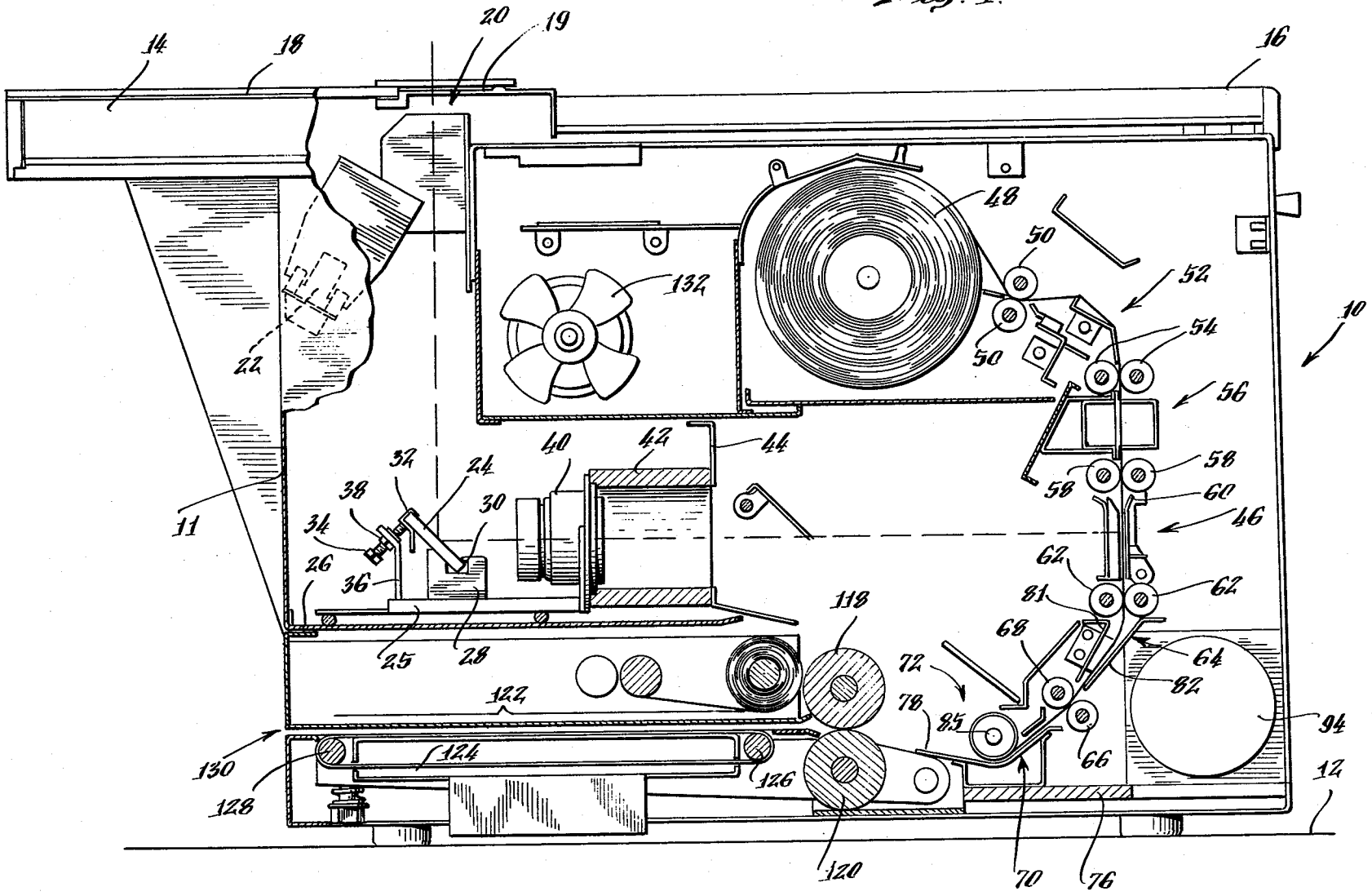
FIG. 1 is a vertical cross-sectional view of the photocopying apparatus of the present invention illustrating all of its principle components including the C-shaped copy sheet feed assembly and the paper guide for guiding the copy sheet under the magnetic brush assembly.

FIG. 1 illustrates the preferred embodiment of the photocopying apparatus of the present invention, generally indicated at 10, installed on a portion of a desk or table top 12. This photocopying apparatus 10 includes a cabinet 11. A document carriage 14, mounted on elongated, horizontal side rails 16 that are, in turn, fastened to the top of the cabinet 11, is adapted for reciprocal movement between a home position at the extreme left of FIG. 1 and a transfer position at the extreme right. A transparent glass bed 18 is mounted on top of the carriage for receiving an original document such as a letter, telegram, or a book page or a copy of an original document. The reciprocating carriage 14 is operable to transport the original document over an aperture 19, formed in the cabinet 11, which defines an illuminating station 20. A high intensity light source 22 is positioned in the cabinet 11 to brightly illuminate the document carried on the glass bed 18 when transported past the aperture 19.

A more detailed description of the reciprocating document carriage is provided in U.S. Pat. No. 3,697,165 (Morriston et al.), assigned to the assignee of the present invention, and incorporated herein by reference.

When illuminated from below by the light source 22, the graphic material on the document face is reflected by a mirror 24 which is adjustably mounted on a table 25 that is, in turn, adapted for horizontal translation on a platform 26 fixed in the interior of the photocopier cabinet 11. The bottom edge of the mirror is supported in an elongate slot 30 formed in mounting block 28. A J-shaped bracket 32 embraces the top edge of the mirror 34 and is supported by an adjustable screw 34 mounted in an upstanding standard 36. By adjusting the screw 34, which is provided with lock nuts 38, the mirror may be tilted to adjust the angle of incidence, and hence, the angle of reflection of the image seen from the aperture 19 of the illuminating station 20.

A lens 40 is also mounted on the translatable table 25 for horizontal movement with the mirror 24. An adjustable sleeve 42 is interposed between the hood of the lens 40 and a vertical partition 44 fixed in the interior of the photocopier housing. The adjustable sleeve may be expanded or contracted to horizontally position the lens and mirror on the platform 26. The lens and mirror which form a lens system are adjustable to properly focus the image projected from the document at the illuminating station to an imaging station generally indicated at 46. This imaging station 46 will be described in greater detail below.

Copy paper is supplied from a continuous supply roll 48 by a pair of initial feed rollers 50 which rotate in opposite directions. The paper supplied from the roll 48 may be provided with a photoconductive coating such as a zinc oxide coating. Copy paper sold under the trademark of Elextrofax is suitable for this purpose.

The copy paper is next fed through a severing mechanism generally indicated at 52 for cutting the paper to the same length as that of the original document. The photocopying apparatus 10 may be provided with an adjustment to vary the length of the copy sheet so produced. This is particularly important in law offices and other businesses which use paper of several lengths.

The severed copy sheet is then fed into a second pair of feed rolls 54 which feed it to a corona charger unit generally indicated at 56. The corona charger unit 56 operates to place a uniform electrostatic charge on the photoconductive coating of the copy sheet.

From the corona charger unit 56, a third pair of feed rolls 58 feed the uniform electrostatically charged copy sheet to the imaging station 46. This imaging station 46 includes a conductive ground plate 60 which is effective to allow discharge of selected areas on the photoconductive coating of the copy sheet when struck in accordance with the image of the original document's graphic matter. The copy sheet is fed through the imaging station in synchronism with the movement of the document through the illuminating station. In this fashion, the entire document is scanned and copied. Thus, the graphic matter or image indicia on the original document is transformed into a corresponding latent electrostatic image on the photoconductive coating of the copy sheet. The latent electrostatic image is identified by the remaining charged areas on the copy sheet which correspond to the image indicia on the original document.

After the copy sheet has been provided with a latent electrostatic image, it is transported by means of a fourth set of feed rolls 62 to a fixed, generally V-shaped, paper guide 64, a set of magnetic brush feed rolls 66 and 68, and a final magnetic brush paper guide 70, to the magnetic brush generally indicated at 72. This assembly for feeding the charged copy sheet to the magnetic brush is illustrated in greater detail in FIGS. 2 and 3.

Figure 3:
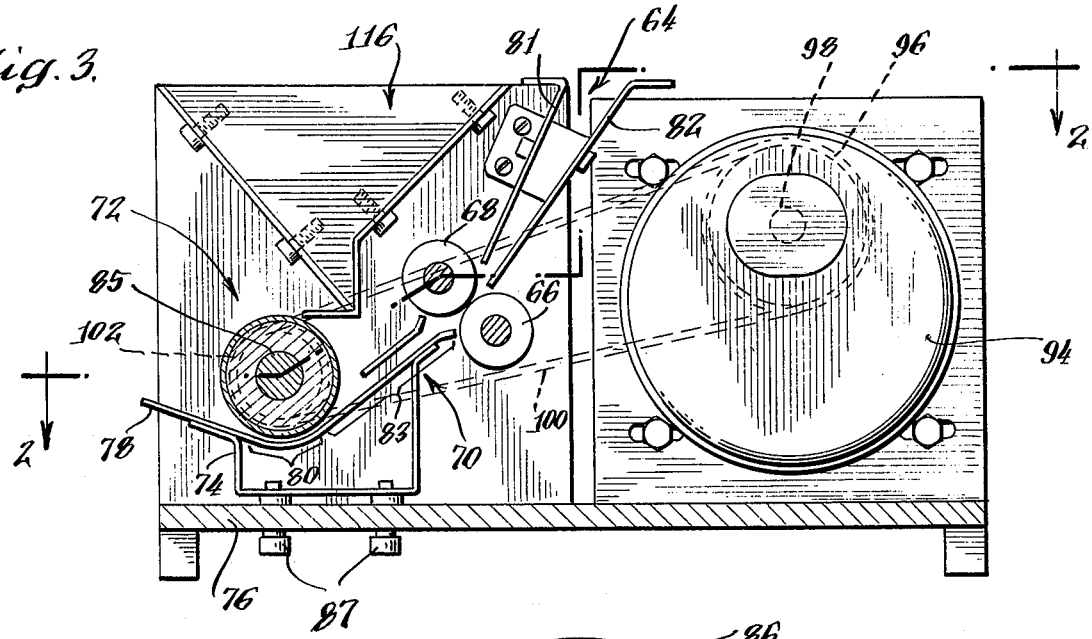
FIG. 3 is a similarly enlarged view, taken through discontinuous plane 3—3 in FIG. 2, of this magnetic brush and the feed rollers immediately upstream of it showing a hopper for holding magnetically responsive toner and the paper guide for guiding copy sheets under the magnetic brush in detail.

The V-shaped paper guide 64 which includes top and bottom guide members 81 and 82 obliquely diverts the downwardly moving copy sheet exiting from the imaging station 46 to the magnetic brush feed rolls 66 and 68 from which it is fed to final paper guide 70. As shown in FIG. 3, paper guide 70 is mounted on a bracket 74 which is fastened to a bottom partition 76 of the photocopier cabinet 11. Further, the guide 70 includes a bottom guide plate 78 having a smoothly curved section 80, that is concentric with and fixed in spaced relation to the magnetic brush 72, and a planar entering section 83.

The bottom guide member 82 of the V-shaped guide 64 forms a large obtuse angle with entering section 83 of the guide plate 78. Moreover, the magnetic brush feed rolls 66 and 68 are oriented to feed the copy sheet into the final paper guide 70 with the leading copy sheet edge in positive contact with the upper surface of the smoothly curved guide plate 78. That is, a tangent from the point of mutual contact between the magnetic brush feed rolls 66 and 68 also makes a large obtuse angle with the upper surface entering section 83 of the bottom guide plate 78. Therefore, the leading edge of a copy sheet exiting rolls 66 and 68 on such a tangent firmly engages final guide planar section 83. As the sheet is driven further down guide 70, it maintains firm contact with the final guide curved section to maintain a desirable space between it and magnetic brush 72. Accordingly, the relative orientation of the V-shaped paper guide 64, the magnetic brush feed rollers 66 and 68 and the final paper guide 70 cooperate to feed the copy sheet under the magnetic brush 72 while maintaining positive copy sheet contact with the smoothly curved bottom guide plate 78. The entire copy sheet, while fed across the bottom guide plate 78, conforms closely to the guide plate contour.

It has been found that this assembly of the V-shaped guide 64, magnetic brush feed rolls 66 and 68, and final magnetic brush paper guide 70 eliminates the need for any additional apparatus to hold the copy sheet in spaced relation to the magnetic brush 72. Therefore, it is not necessary to provide a vacuum platen or a paper tensioning device to hold the copy sheet in positive contact with the upper surface of the smoothly curved bottom paper guide plate 78.

The final paper guide bottom plate 78 is mounted spaced from the magnetic brush 72, as noted above, to provide optimum contact between the copy sheet surface and the magnetic toner carried on the brush. The bottom plate mounting bracket may be held by adjustable screws 87 tapped into the bottom platform 76 to set this spacing.

Figure 2:
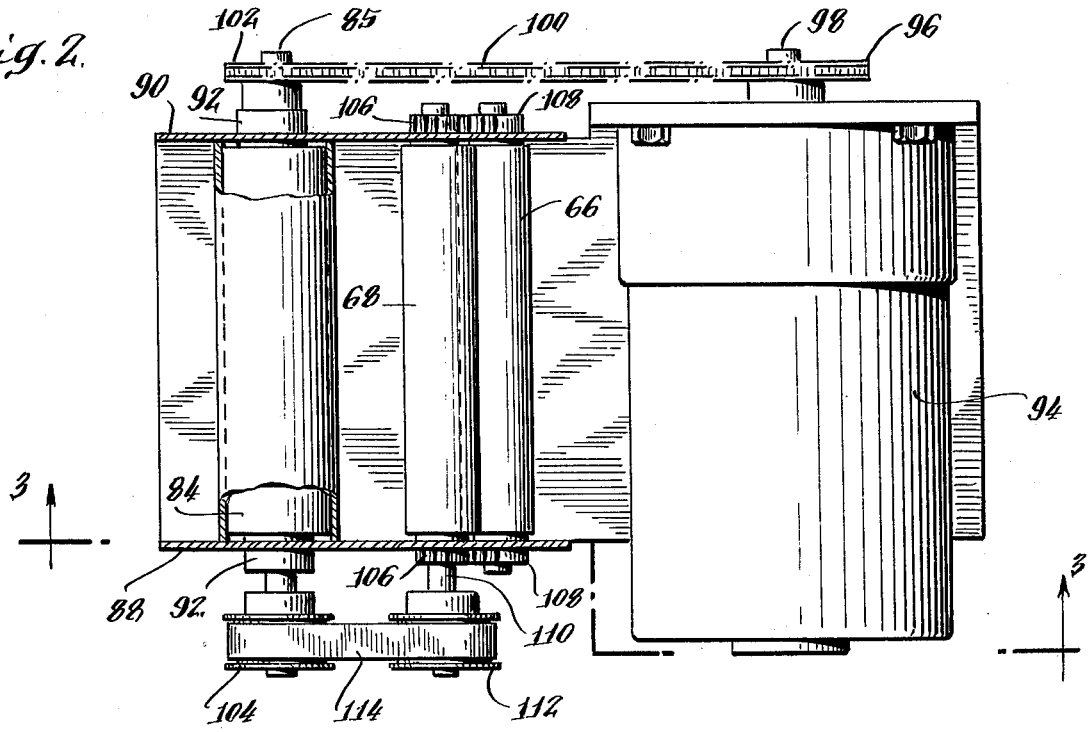
FIG. 2 is an enlarged cross-sectional view, taken through discontinuous plane 2—2 in FIG. 3, of the magnetic brush assembly, the feed rollers on the immediate upstream side of the magnetic brush and a single drive assembly for driving both the magnetic brush and the rollers.
Figure 4:
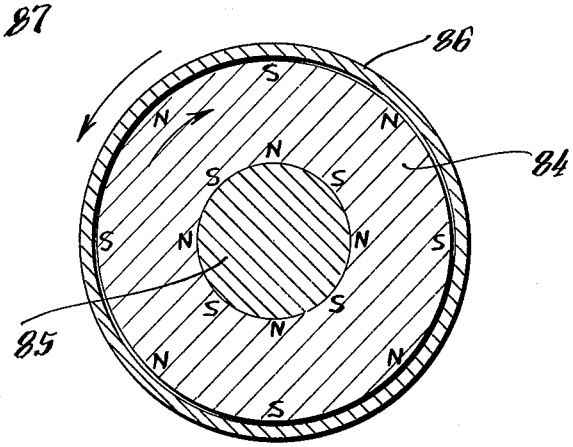
FIG. 4 is a cross-sectional view illustrating the construction of the magnetic brush.

The magnetic brush, shown in detail in FIGS. 2 and 4, includes a magnetically permeable shaft 85 and a permanently magnetized cylinder 84, mounted for rotation with the shaft 85. The permanently magnetized cylinder 84 is preferably formed from a solid matrix of non-magnetic material such as rubber, an epoxy resin, or elastomeric semisolid, or a viscous liquid which is capable of being hardened or cured to a solid state. A large number of antisotropic particules of, for example, Alnico or ferrites of barium, lead and strontium (see U.S. Pat. No. 3,455,276 (Anderson)), capable of being permanently magnetized, are embedded in the matrix. During the magnetic polarization process of the cylinder 84, various symmetrical, magnetic regions are formed, in each of which the magnetizable particles are oriented with like magnetic poles positioned the same way radially relative to each other. As shown in FIG. 4, the cylinder has eight separate circumferential poles. Since the magnetic particles embedded in the cylinder matrix are commonly oriented, each region forms a permanent magnet, for example, having a north pole at the radial outer surface of the cylinder and a south pole at the radial inner surface of the cylinder. Circumferentially adjacent poles are oppositely polarized.

As shown in FIGS. 2 and 4, the magnetic brush cylinder 84 is mounted in radially spaced relation for rotation within a sleeve 86 formed from a non-magnetic material which will not shield the magnetic cylinder's field. As shown in FIG. 2, The sleeve 86 is fixed between two vertically upstanding partitions 88 and 90 mounted in the interior of the photocopier cabinet 11. The magnetic brush cylinder 84 is mounted on its shaft 85 which is carried in antifriction bearings 92 mounted in the partitions 88 and 90.

A motor 94 is provided with a sprocket 96 mounted on its shaft 98 and cooperates with an endless chain 100 and a second sprocket 102 mounted on the shaft 85 to rotate the magnetic brush cylinder 84 relative to the magnetic brush sleeve 86. The end of the shaft 85 opposite that which carries the second sprocket 102 carries a pulley 104. The magnetic brush feed rolls 66 and 68 are also mounted for rotation between the partitions 88 and 90 and are coupled by interengaged gears 106 and 108 to be driven in opposite directions. The shaft 110 on which the feed roll 68 is mounted extends beyond the partition 88 and is provided with a pulley 112 similar to the pulley 104. An endless belt 114 interconnects the pulleys 104 and 112 to drive the magnetic brush feed rolls when the magnetic brush is driven by the motor 94.

A hopper generally indicated at 116 is mounted above the magnetic brush 72 between the partitions 88 and 90 for delivering a magnetic toner material to the outer surface of the magnetic brush sleeve 86. When deposited on this outer surface, the toner appears to tumble under the effects of the changing directions of the magnetic field caused by the rotating magnetic cylinder and move in a direction opposite to the rotation of that cylinder. That is, when the magnet core cylinder rotates clockwise as shown in FIG. 4, the developing powder appears to tumble down the outside of the magnetic brush sleeve 86 in a counterclockwise direction.

When the charged copy sheet carrying the latent electrostatic image is passed under the magnetic brush 72, driven by the feed rolls 66 and 68 and guided by the smoothly curved paper guide bottom plate 78, it contacts the developer powder carried on the magnetic brush outer sleeve 86. The paper guide bottom plate 78 is spaced from the magnetic brush sleeve 86, as noted above, so that the charged copy sheet makes proper contact with the developer powder. At this time, the magnetically responsive developer powder is electrostatically attracted to the charged areas on the copy sheet to develop the latent electrostatic image.

Referring again to FIG. 1, the smoothly curved magnetic brush paper guide 70 further directs the developed copy sheet to a pair of fusing rollers 118 and 120. These rollers are mounted in the photocopier cabinet 11 for rotation in opposite directions and may be springloaded to be pressed tightly together. The fusing roller 118 may be heated, if desired.

The pressure developed between the fusing rollers 118 and 120 fixes the toner to the copy sheet when passed therebetween. Prior to fixing, the toner is only loosely held against the copy sheet by the electrostatic attraction of the toner for the charged areas on the sheet.

The copy sheet is then fed from the fusing rollers 118 and 120 to region 122. An endless belt 124 is mounted on two spaced rollers 126 and 128 and transports the finished copy through the region 122 to exit from a delivery slot 130. Here the final copy is delivered to the operator.

A fan 132 is mounted in the interior of the photocopier cabinet 11 to cool the components, such as the light source 22, which develope considerable heat in operation.

As can be seen in FIG. 1, the copy sheet is transported by five sets of feed rolls and several paper guides through a generally C-shaped, nonlinear path. The copy sheet supplied from the roll 48 begins its travel along this C-shaped path with the photoconductive coating facing generally downward. In particular, the C-shaped path includes a first generally horizontal leg along which the paper is transported from the supply roll 48 to the severing mechanism 52. After traversing the severing station 52, the copy sheet is transported through a generally vertical leg of the C-shaped path. During its travel through this vertical leg, the copy sheet is charged by the corona charger unit 56, and allowed to discharge in selected areas at the image station 46 leaving a latent electrostatic image corresponding to the image on the document. Here the photoconductive coating of the copy sheet is faced generally inward toward the lens 40 and the mirror 24. After traversing the vertical C-shaped path leg, the copy sheet traverses a second generally horizontal leg to be conducted under the magnetic brush 72 where the electrostatic image is developed. During travel through this leg, the photoconductive coating on the copy sheet faces generally upward. After the latent electrostatic image on the copy sheet is developed and fixed by the fusing rollers 118 and 120, it is then delivered from the final portion of the second horizontal leg of the C-shaped path.

The C-shaped nonlinear copy sheet feed path defined by the various mechanisms for feeding the copy sheet from the supply roll sequentially to the severing mechanism, the corona charger unit, the imaging station, the magnetic brush, and the fusing rollers provides several advantages. Because the path which the copy sheet follows is not linear and particularly because it is not entirely horizontal, the photocopying apparatus 10 of the present invention may be housed in a compact cabinet. Accordingly, this photocopying apparatus is economical of space and may be conveniently installed on a desk or table top for easy operation. Access to paper supply is convenient. Further, the developed copy sheet is delivered to the operator at a location near that where he fed the apparatus with the original document.

The copy sheet feed mechanism which includes a smoothly curved paper guide plate 78 for guiding the paper under a magnetic brush 72 further eliminates the necessity for providing an auxiliary system to hold the paper in spaced relation to the magnetic brush. In particular, no paper tensioner or vacuum platen is necessary to hold the copy sheet in spaced relation to the magnetic brush. Accordingly, the latent image formed on the copy sheet is accurately and properly developed by the developing toner carried on the magnetic brush.

The copy sheet feed mechanism also provides advantages which flow from conducting the copy sheet under the magnetic brush rather than over or past the side of the magnetic brush. In particular, a clearer, more distinct image is produced on the copy.

Although a specific embodiment of the present invention has been disclosed in detail above, it is to be understood that this is merely for purposes of illustration. The disclosure should not be construed as limiting the scope of the invention, since changes may be made to the described structures by those skilled in the art to adapt this photocopying apparatus to particular applications.

What is claimed is:

1. An apparatus for photocopying image indicia from a document onto a copy sheet having a photoconductive surface including:

an illuminating station for receiving the document and for illuminating the document image indicia;

a lens for projecting the document image indicia onto the photoconductive surface of the copy sheet;

a corona charger for placing a uniform electrostatic charge on the photoconductive surface of the copy sheet;

means for feeding the copy sheet from the corona charger to an imaging station at which the uniformly charged copy sheet receives the projected document image indicia from said lens;

a magnetic brush developing means for placing magnetically electrostatically attractable toner material on the photoconductive surface of the copy sheet, said magnetic brush developing means comprising:

1. a magnetic brush having a peripheral surface,
2. a pair of contacting feed rollers mounted for mutual rotation in opposite directions and spaced from said magnetic brush for feeding a copy sheet from said imaging station toward said magnetic brush,
3. a copy sheet guide for directing a copy sheet from said feed rollers to said magnetic brush, said copy sheet guide having
   a. a planar portion having an upper surface disposed at an obtuse angle with respect to a tangent from the point of mutual contact of said feed rollers for receiving the leading edge and successive portions of the copy sheet, and
   b. a curved portion merging with said planar portion and extending beneath said magnetic brush in concentric spaced relationship therewith, whereby the leading edge and successive portions of the copy sheet are directed toward said upper surface at said obtuse angle to cause said copy sheet to continuously contact said guide plate and thereby closely conform to the contour of said guide plate as the copy sheet comes into contact with the particulate toner on said magnetic brush.

2. The photocopying apparatus of claim 1 further comprising means for adjusting the spaced distance between said magnetic brush and said copy sheet guide.

3. The photocopying apparatus of claim 1 further comprising a cabinet for housing said photocopying apparatus including a fixed bottom platform and a plurality of adjustment screws taped into said bottom cabinet platform to hold said copy sheet guide, said adjustment screws providing relative adjustment of the distance between said copy sheet guide and said magnetic brush.

* * * * *